United States Patent [19]

Mueller

[11] 4,010,598

[45] Mar. 8, 1977

[54] DEVICE FOR FOLDING THE CLOSURE FLAP OF ENVELOPES

[75] Inventor: Heinz Jakob Mueller, Hollidaysburg, Pa.

[73] Assignee: F. L. Smithe Machine Company, Inc., Duncansville, Pa.

[22] Filed: Feb. 27, 1975

[21] Appl. No.: 553,640

[52] U.S. Cl. ..... 53/376; 53/206; 53/234; 270/68 R

[51] Int. Cl.[2] ..... B65B 7/20

[58] Field of Search ..... 53/31, 38, 206, 225, 53/234, 266, 376; 93/27, 61 R, 62, 63 R, 63 M; 270/68 R; 198/25, 480, 636

[56] References Cited

UNITED STATES PATENTS

| | | | |
|---|---|---|---|
| 1,152,794 | 9/1915 | Cox | 53/234 X |
| 1,984,850 | 12/1934 | Van Buren | 53/225 |
| 2,131,428 | 9/1938 | Dalkowitz | 53/206 |
| 2,240,989 | 5/1941 | Hood | 198/25 |
| 2,522,234 | 9/1950 | Mills | 53/234 X |
| 2,602,531 | 7/1952 | Plank | 198/25 X |
| 2,820,573 | 1/1958 | McConnell | 198/25 X |
| 3,055,490 | 9/1962 | Anderson | 198/25 X |
| 3,438,176 | 4/1969 | Reil | 53/234 X |
| 3,537,362 | 11/1970 | Harper | 93/62 |
| 3,564,979 | 2/1971 | Weber | 93/27 |

*Primary Examiner*—Travis S. McGehee
*Assistant Examiner*—John Sipos
*Attorney, Agent, or Firm*—Stanley J. Price, Jr.; John M. Adams

[57] ABSTRACT

The closure flap folding device includes a first conveying means arranged to convey envelopes having open closure flaps into a rotating receiver. The receiver includes a pair of spaced discs mounted on a shaft and the discs have a plurality of radially extending spaced slots therein forming radially extending fingers therebetween. The fingers have a generally square peripheral edge portion and resilient members secured thereto that extend into adjacent slots. An adjustable guide member is positioned between the spaced discs and positions the envelopes within the slot so that the closure flap score line is aligned with the square peripheral edge of the adjacent finger. An arcuate flap folding member is positioned around a portion of the discs and has a portion that converges toward the outer peripheral edge of the discs. As the receiver rotates the closure flaps of the envelopes in the slots contacts the inner surface of the arcuate folding member and the closure flap is partially folded along the score line. A second conveying device is provided to convey the envelope with the partially folded closure flap between a pair of pressure rolls to complete the folding of the closure flap. The envelopes with the folded closure flap are conveyed by the second conveying means to a suitable envelope delivery device.

5 Claims, 4 Drawing Figures

DEVICE FOR FOLDING THE CLOSURE FLAP OF ENVELOPES

BACKGROUND OF THE INVENTION

1. Field of the Invention

This invention relates to apparatus for folding the closure flap of envelopes and, more particularly, to apparatus for folding the closure flap of an envelope that includes a rotatable receiver having a plurality of envelope receiving radial slots therein.

2. Description of the Prior Art

In the past, envelope closure flaps have been folded be several different types of folding devices. For example, the envelope closure flap was folded by means of a reciprocating blade that engaged the score line of the closure flap and fed the partially folded closure flap between a pair of pressure rollers. The pressure rolls completed the folding of the closure flap against the body of the envelope. This type of folding device was slow and not suited for present day high speed envelope making machines.

As an improvement over the reciprocating blade type folding device, the so-called "upset folding" devices were developed. The "upset folding" device conveys the envelope into a trap having a stop device that stops the envelope blank when the closure flap score line is positioned between a pair of pressure roll. The pressure rolls engage the envelope along the closure flap score line and fold the closure flap over the envelope body. This type of closure flap folding device also limits the speed of the envelope making machine because the envelope is conveyed into a trap against a stop device and the envelope must stop and reverse direction. Also, the envelopes frequently fill with air during the folding operation and cause jams and machine malfunctions.

To eliminate the problem of collecting air in the envelope while the closure flap is being folded, rotary type closure flap folding devices, such as that illustrated in U.S. Pat. No. 3,668,982, were developed. The roll-type closure flap folding devices require suction devices to maintain the envelopes on the rolls and further are limited by the small number of envelopes that can be positioned on the closure flap roll at one time. This arrangement also limits the output rate of the envelope making machine.

There is a need for a relatively simple device for folding the envelope closure flaps at a high speed without collecting air in the envelopes during the folding of the closure flap.

SUMMARY OF THE INVENTION

This invention relates to closure flap folding device that includes a first conveying means to convey envelopes in spaced tandem relation into a rotating receiver. The receiver includes a plurality of disc members rotatably mounted adjacent the first conveying means. The disc members have radially extending spaced slotted portions forming radially extending fingers therebetween. Resilient means are secured to the fingers and extend into the adjacent slots. An envelope guide member is positioned between the disc members and engages the bottom edge of the envelope and urges the envelope outwardly to a position where the closure flap score line is positioned in underlying relation with a generally rectangular radial edge portion of the adjacent finger. An arcuate flap folding member is positioned around a portion of the disc members and has a portion converging toward the periphery of the disc members. Upon rotation of the receiver, the envelope closure flap moves into abutting relation with a surface of the closure flap folding member to partially fold the closure flap along the closure flap score line. A second conveying means is provided to engage the envelope and convey the envelope outwardly from the slot in the disc members to a location between a pair of pressure rolls. The pressure rolls crease the envelope along the closure flap score line with the closure flap in overlying relation with the body of the envelope. The pressure rolls also serve to convey the envelopes with the closed closure flap into a suitable envelope delivery device.

Both the envelope guide member and closure flap folding member are adjustable so that the closure flap folding device may be utilized with different sized envelopes. They are also adjustable while the closure flap folding device is in operation. The resilient means connected to the radially extending fingers frictionally engages the envelopes in the slot and maintains the envelopes in a preselected position within the slots while the closure flap is partially folded by the closure flap folding members. One of the pressure rolls is eccentrically mounted to exert a creasing pressure when the closure flap score line is in the nip between the pressure rolls.

Because of the plurality of radially extending slots in the disc members, the disc members rotate at a peripheral speed substantially less than envelope machine speed. Since the speed of the disc members is less than the envelope machine speed, the closure flap apparatus is not a limiting factor in envelope machine speed and the speed of the closure flap folding apparatus may be increased as the speed of the envelope machine in increased without materially affecting the operation of the closure flap folding apparatus. The envelopes are conveyed into the slots with the bottom edge first so that air cannot be entrapped in the envelope during the flap closing operation.

DESCRIPTION OF THE PREFERRED EMBODIMENT

Figure 1:
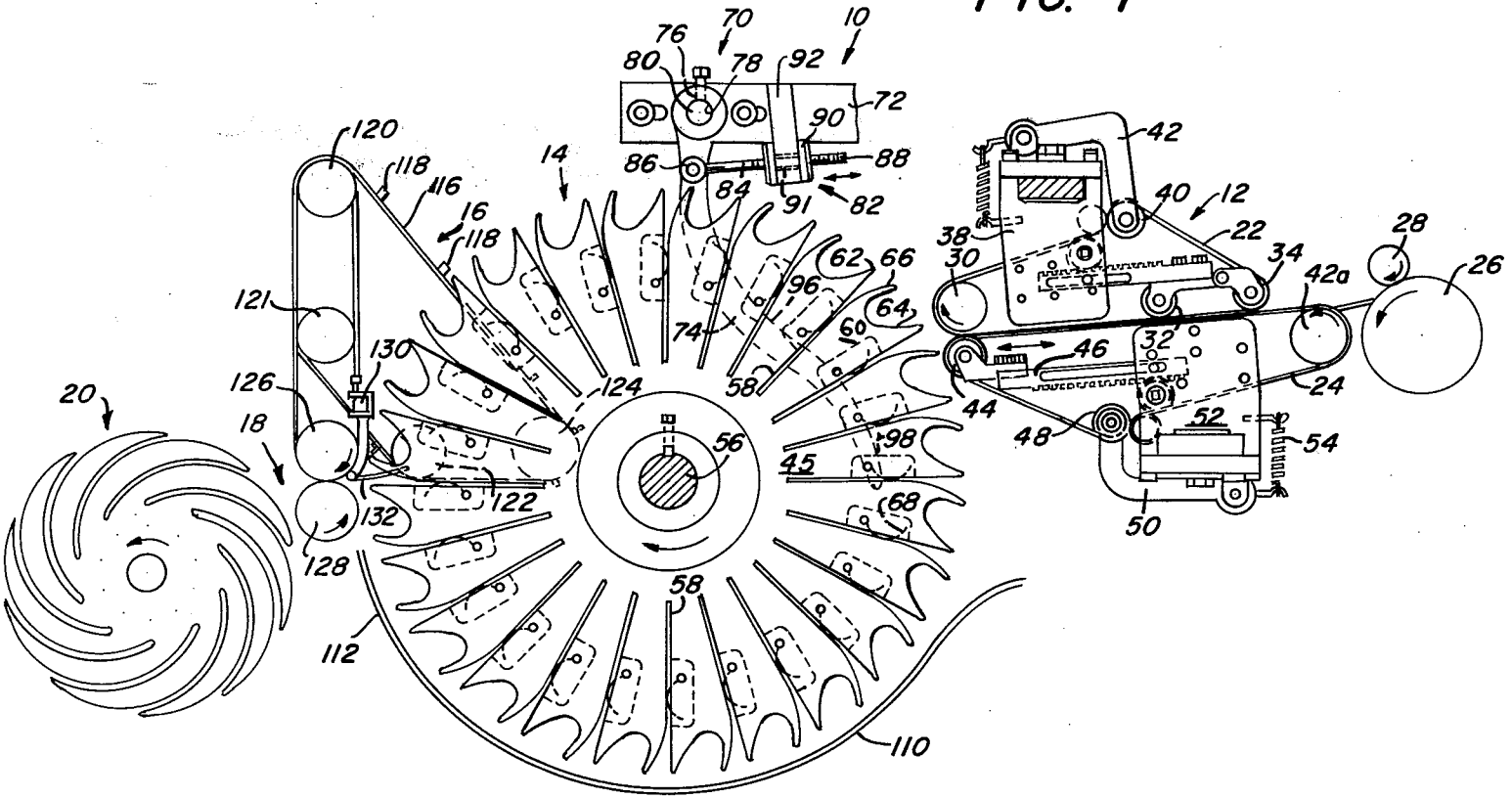
FIG. 1 is a generally schematic view, in side elevation of my improved closure flap folding device.

The closure flap folding device is schematically illustrated in FIG. 1. It should be understood that the elements of the closure flap folding device are suitably mounted on the frame member of an envelope making machine and the rotatable elements are suitably driven at preselected speeds by means of suitable drive devices that can also be associated with the envelope making machine. Although the closure flap folding device is described as being associated with an envelope making machine it should be understood that the envelope closure flap folding device may be utilized as a separate device for folding the closure flaps of envelopes having inserts positioned therein.

The closure flap folding device generally designated by the numeral 10 includes a first conveying means 12 that conveys envelopes to a rotatable receiver 14. The envelopes with a partially folded closure flap are conveyed by a second conveying means generally designated by the numeral 16 from the rotatable receiver to pressure rolls 18, where the closure flap is creased along the score line and the envelope with the folded closure flap is conveyed to a delivery device 2.

Referring to FIG. 1, the first conveying means includes a pair of endless belts 22 and 24 which are suitably supported to receive an envelope therebetween. The envelopes are conveyed from a bottom flap folding device of the envelope machine schematically illustrated by rolls 26 and 28. The envelopes are fed at envelope machine speed from the bottom flap folding device to the first conveying device 12 and the speed of the envelopes is increased by the first conveying means as they are fed to the rotatable receiver 14.

The upper endless belt 22 is reeved about an end roll 30 and intermediate rolls 32 and 34. The intermediate rolls 32 and 34 are mounted on a support 36 that is movable longitudinally toward and away from roll 30 to accommodate different sized envelope blanks. An upper feed carriage 38 has the endless belt 22 reeved about a tension roll 40 that in connected to arm 42. The arm 42 is, in turn, resiliently urged upwardly to maintain tension on the belt 22 through roller 40. The roller 30 is preferably a driven roller that propels the belt 22 at a preselected speed, preferably between twice and three times machine speed.

Similarly, the endless belt 24 of the conveying device 12 is reeved around a fixed roller **42*a* and a movable roller 44. The roller 44 is mounted on a supporting device 46 that is movable longitudinally toward and away from roller 42*a* to accommodate different sized envelopes. The belt 46 is reeved about tension roll 48 which is, in turn, rotatably secured to a lever 50. The lever 50 is pivotally secured on the lower feed carriage 52 and connected to a spring 54. The spring 54 through lever 50, maintains preselected tension on belt 24. The roller 42*a* is preferably a driven roller that drives the endless belt 24 at the same preselected speed as belt 22. The support member 36 is adjustable toward and away from the bottom flap folding device designated by rolls 26 and 28 so that it can engage different sized envelopes after the envelope has left the nip between rolls 26 and 28. Similarly, the support device 46 may be adjusted to move roll 44 to control the angle at which the envelope is discharged from the conveying means 12.**

The rotatable receiver 14 includes a pair of discs 45 that are non-rotatably mounted on a common shaft 56 for rotation therewith. The discs 45 are positioned in spaced relation to each other and have the same configuration. Only one disc is shown in FIG. 1 but it should be understood that two or more discs may be positioned on shaft 56 in spaced relation to each other. The disc 45 has a plurality of spaced radially extending slots 58 which form radially extending fingers 60 therebetween. The slots 58 extend from the outer periphery of the disc to a location adjacent the shaft 56. The fingers 60 have a generally rectangular or square edge portion 62, an arcuate intermediate recessed portion 64 and a bent other end portion 66. Each of the fingers 60 has a spring member 68 secured thereto with a portion extending into the adjacent slot 58. The arcuate spring member 68 is arranged to frictionally engage an envelope blank positioned in the slot 56.

An envelope guide member generally designated by the numeral 70 has a support portion 72 with an arcuate guide member 74 depending therefrom. The guide member 74 has an end portion 76 with a bore 78 therethrough. The support 72 has a shaft 80 which extends through the bore 78 in guide member 74. With this arrangement, the guide member 74 is pivotally supported on the support member 72. An adjusting member 82 has a rod 84 that is pivotally secured at 86 to a portion of the guide member 74 below the end portion 76, the rod 84 has a threaded end portion 88 with adjusting nuts 90 positioned thereon. A bar 92 extends downwardly from the support member 72 and has a bore 94 therethrough. The rod 84 extends through the bore 94 and the nuts 90 abut opposite side portions of the bar. With this arrangement, rotation of the nuts 90 on rod 84 will controllably pivot the guide member 74 about the shaft 80.

The guide member 74 has an arcuate outer edge portion 96 with a reverse curved lower end 90. The guide member 74 is positioned between the disc members 14 and is arranged to control the opposite of the envelopes within the solts 58. The envelopes are propelled into the slots 58 by the first conveying device 12 with the bottom edge of the envelope blanks as the leading edge. The bottom edge of the envelope blank strikes the guide member edge 96 and limits inward movement of the envelope blank. The bottom edge of the envelopes remain in abutting relation with the edge of guide member 74 and, as the receiver 14 rotates the guide member 74, moves the envelope outwardly in the slot 58 to a location where the closure flap score line is aligned with the relatively sharp rectangular edge 62 of the adjacent finger 60.

Figure 2:
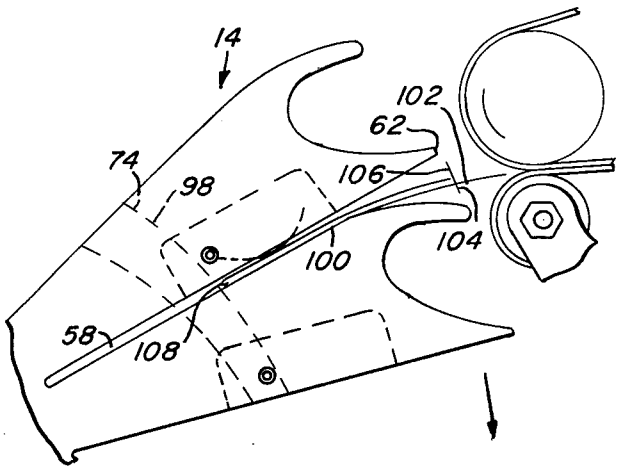
FIG. 2 is an enlarged fragmentary view, in side elevation, of a portion of one of the disc members as it receives an envelope from the first conveying means.

As illustrated in FIG. 2, the envelope is diagrammatically designated by the numeral 100 with a closure flap 102 and a closure flap score line 104. For clarity, the relative location of the score line 104 is designated by the line 106. It should be noted that the envelope bottom edge 108 is abutting the edge 98 of guide member 74. In practice, however, the guide member edge 96 is positioned further back with respect to the slot 58 so that the envelope will penetrate the slot at a location where the closure flap score line 104 is within the slot 58. As the receiver 14 rotates, the envelope bottom edge 108 is moved outwardly by the guide member edge 98 so that the closure flap score line 104 will be aligned with the finger edge portion 62.

Figure 3:
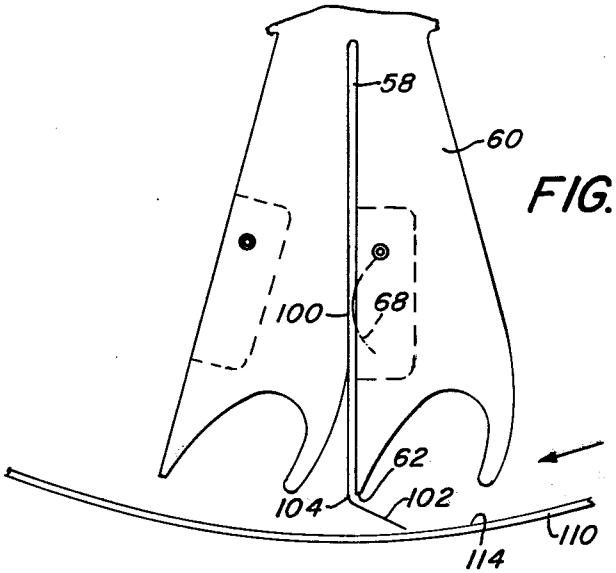
FIG. 3 is an enlarged fragmentary view, in side elevation, of a portion of one of the disc members, illustrating the manner in which the closure flap is partially folded during rotation of the receiver.
Figure 4:
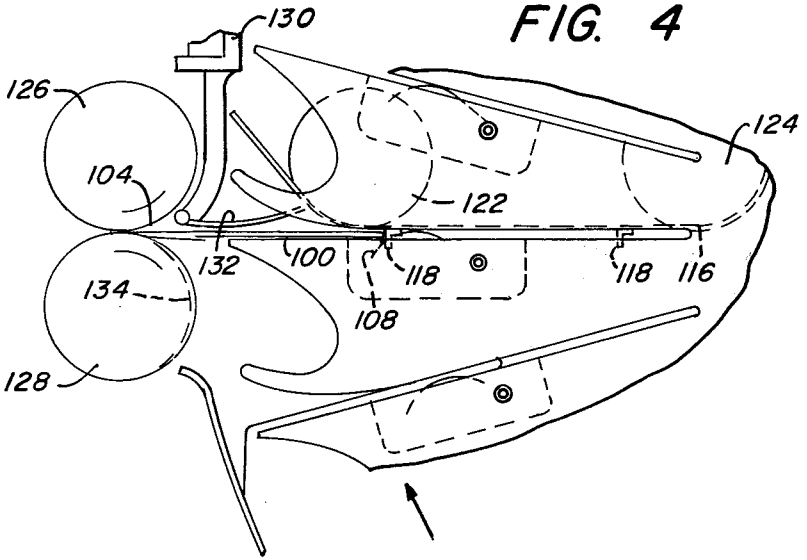
FIG. 4 is an enlarged fragmentary view or one of the disc members illustrating the envelope being conveyed by the second conveying means into the nip between the pressure rolls.

As illustrated in FIGS. 1 and 3, an arcuate closure flap folding member 110 is positioned beneath the receiver 14 and has a generally circular configuration with an end portion 112 converging toward the peripheral edge of the receiver 14. The closure flap folding member 110 is adjustable toward and away from the periphery by receiver 14. FIG. 3 illustrates the envelope 100 fixedly secured within the slot 58 by means of the spring 68 secured to the finger 60. The envelope assumes the position illustrated in FIG. 3 as it moves past the guide member lower edge 98. As the receiver 14 rotates, the envelope closure flap 102 abuts the inner surface 114 of the closure flap folding member 110 and the closure flap 102 abuts the edge 62 of finger 60 at the closure flap score line 104 to partially fold the closure flap. As the receiver continues to rotate and the folding member inner surface 114 converges toward the periphery of receiver 14, the closure flap is folded to a position as illustrated in FIG. 4. Thus, the closure flap 102 of the envelope is partially folded by means of arcuate folding member 110 as the receiver 14 rotates in a clockwise direction, as illustrated in FIG. 1 and the envelope approaches the second conveying means 16.

The second conveying means includes an endless belt 116 with a plurality of outwardly spaced protuberances 118 thereon. The endless belt is reeved about roller 120, 121, 122 and 124 that are suitably driven at a preselected speed so that the protuberances engage the envelope bottom edge 108 and move the envelope outwardly from the slot 58 when the envelope is aligned with a pair of pressure rolls 126 and 128. A stop member 130 is positioned between the pressure rolls and the periphery of the receiver 14. The stop member 130 has a curved bottom guide portion 132 that is arranged to guide the envelope between the pressure rolls 126 and 128. The stop member 130 is also adjustable vertically.

One of the pressure rolls preferably is elliptical in shape as indicated by the dotted line 134 so that the nip of the rolls 126 and 128, while the closure flap score line 104 is therebetween, will exert a substantial creasing force on the closure flap to fold the closure flap over the body of the envelope 100 and thereafter, exert a sufficient force to propel the folded envelope into a spiral type delivery device 20 without wrinkling the remainder of the envelope.

It should be understood that other types of conveying means may be utilized to position the envelopes within the slots of receiver 14 and to remove the envelopes from the slots and introduce the envelopes with the partially folded flap between the pressure rolls. It should be noted that, with the above described device, a substantial number of envelopes may be positioned within the slots of the rotatable receiver 14 while they are progressively being folded and the peripheral speed of the rotating receiver may be maintained substantially below the envelope machine speed and thus provide a folding device that is capable of operating at high speed. Also, the rotatable feature of the receiver eliminates the reciprocating inertia forces present in the conventional folding devices. The feature of introducing the envelope into the rotatable receiver with the envelope bottom edge as the leading edge eliminates the problem the envelope billowing due to the entrapment of air therein.

The above described closure flap folding device is ideally suitable for use with envelopes containing heavy insert material. The relatively slow motion of the folding device permits the envelopes with heavy inserts therein to be folded without wrinkling the envelopes and also provides an arcuate fold along the closure flap seal. A shut off device may be associated with the stop member 130 to shut off the closure flap folding device, should a malfunction occur that results in the receiver transporting the envelope beyond the second conveying means 16.

According to the provisions of the patent statutes, I have explained the principle, preferred construction and mode of operation of my invention. However, it should be understood that, within the scope of the appended claims, the invention may be practiced otherwise than as specifically illustrated and described.

I claim:

1. A device for folding the closure flaps of envelopes comprising, a rotatable receiver having a plurality of discs mounted on a shaft, each of said discs having a plurality of radially extending spaced slotted portions with radially extending finger portions therebetween, first conveyor means positioned on one side of said rotatable receiver, said first conveyor means arranged to feed envelopes with open closure flaps into said receiver slotted portion with the envelope bottom edge as the leading edge of the envelope, an envelope guide member positioned adjacent to said receiver slotted portions, said guide member arranged to abut the envelope bottom edge and move the envelope within the slot to a location where the envelope closure flap extends outwardly beyond the periphery of said receiver member, an arcuate flap folding member positioned adjacent the periphery of said receiver member, said flap folding member operable to partially fold the envelope closure flap of envelopes positioned in said receiver slotted portions as said receiver member slotted portions rotate away from said first conveying means, said rotatable receiver finger portions having a generally rectangular edge portion arranged to abut the envelope adjacent the closure flap score line, second conveying means positioned on the other side of said rotatable receiver, a pair of pressure rolls positioned adjacent to said second conveying means, said second conveying means arranged to convey the envelopes with the partially folded closure flap outwardly from said receiver member slotted portions and between said pressure rolls, and said pressure rolls arranged to crease the envelope closure flap along the closure flap score line and thereby complete the fold of the closure flap.

2. A device for folding the closure flaps of envelopes as set forth in claim 1 which includes, resilient means secured to said radially extending finger portions, said resilient means extending into the adjacent slotted portion of said rotatable receiver, said resilient means arranged to engage said envelope within said slotted portion.

3. A device for folding the closure flaps of envelopes as set forth in claim 1 in which, said envelope guide member is adjustable toward and away from the periphery of said receiver to accommodate different sized envelopes.

4. A device for folding the closure flaps of envelopes as set forth in claim 1 in which, one of said pressure rolls is eccentrically mounted to provide a corresponding pressure on the envelope as the closure flap score line is positioned therebetween and thereafter a sufficient pressure to convey the envelope to a delivery device.

5. A device for folding the closure flaps of envelopes as set forth in claim 1 which includes, a stop member positioned adjacent to said second conveying means and said pressure rolls, said stop member arranged to guide the envelope between the pressure rolls.

* * * * *